US007387595B2

(12) United States Patent
Towley, III et al.

(10) Patent No.: US 7,387,595 B2
(45) Date of Patent: Jun. 17, 2008

(54) EXERCISE MACHINE USING LEVER MOUNTED SELECTORIZED DUMBBELLS AS EXERCISE MASS

(75) Inventors: Carl K. Towley, III, Alexandria, MN (US); Gregory S. Olson, Owatonna, MN (US)

(73) Assignee: Intellex, Inc., Owatonna, MN (US)

( * ) Notice: Subject to any disclaimer, the term of this patent is extended or adjusted under 35 U.S.C. 154(b) by 126 days.

(21) Appl. No.: 10/919,128

(22) Filed: Aug. 16, 2004

(65) Prior Publication Data

US 2006/0035766 A1 Feb. 16, 2006

(51) Int. Cl.
*A63B 21/062* (2006.01)
*A63B 21/08* (2006.01)
*A63B 21/00* (2006.01)

(52) U.S. Cl. ..... 482/100; 482/97; 482/135

(58) Field of Classification Search ..... 482/97–104, 482/106–108, 135–138
See application file for complete search history.

(56) References Cited

U.S. PATENT DOCUMENTS 4,598,908 A * 7/1986 Morgan ..... 482/138
5,358,462 A * 10/1994 Calderone ..... 482/137
5,472,397 A * 12/1995 Ammoscato et al. ..... 482/104
6,074,328 A 6/2000 Johnson
6,755,770 B2 * 6/2004 Martens ..... 482/99
7,094,185 B2 * 8/2006 Greenland ..... 482/100

OTHER PUBLICATIONS

PowerBlock Workout Manual, 1995.
Paramount Direct Power Brochure, 1998.

* cited by examiner

*Primary Examiner*—Fenn C. Mathew
(74) *Attorney, Agent, or Firm*—James W. Miller

(57) ABSTRACT

This invention relates to an exercise machine having an exercise station that includes an exercise bench and one or more exercise implements for allowing a user to perform one or more exercises. An adjustable exercise mass assembly is oriented perpendicularly to the exercise station and includes a pivotal lever. An exercise mass is carried on the pivotal lever and is movable back and forth thereon towards and away from the pivot axis of the pivotal lever to adjust the exercise resistance provided by the exercise mass. The exercise mass preferably comprises at least one selectorized dumbbell. Portions of the dumbbell can be removed from the pivotal lever for use as a dumbbell while some of the weights of the selectorized dumbbell remain in place on the pivotal lever. This allows the mass provided by the selectorized dumbbell(s) to be simultaneously used by multiple users.

31 Claims, 9 Drawing Sheets

EXERCISE MACHINE USING LEVER MOUNTED SELECTORIZED DUMBBELLS AS EXERCISE MASS

TECHNICAL FIELD

This invention relates to an exercise machine having an exercise station at which a user can perform at least one exercise. More particularly, this invention relates to such an exercise machine in which an exercise mass is adjustably carried on a pivotal lever.

BACKGROUND OF THE INVENTION

Weight training has traditionally been done using free weights. Free weights comprise a plurality of individual weights that can be loaded in various configurations onto the ends of a weight lifting bar. Each free weight has a central bore to allow the weight to be slipped onto the end of the bar. Free weights are usually circular in shape and are made in large quantities out of cast iron or the like.

Free weights are quite efficient in accommodating relatively large numbers of users. This is so because different users will usually not require the same amount of weight when exercising. While one user might need 200 pounds for a workout, the next user might only require 50 pounds, a third user 25 pounds, and so on. Thus, the individual users simply use the numbers of free weights that they require. The other free weights are available for use by other users.

However, free weights have some disadvantages. For one thing, to adjust the exercise mass, the user must add or subtract weight from the weight lifting bar. This can be time consuming and annoying when the user needs a different exercise mass for each different exercise. In such a case, after finishing one exercise, the user must stop and adjust the number of free weights carried by the bar before beginning the next exercise.

In addition, free weights or a weight lifting bar carrying such weights can be accidentally dropped by the user. This is particularly true if the user has loaded too much weight on the bar or is a relatively inexperienced weight lifter. This poses a safety risk. The user or a bystander can be injured if a bar or a free weight is dropped and strikes the user or the bystander.

As a consequence, various exercise machines have been developed that use a weight stack for providing the exercise mass. The weight stack typically comprises a vertical array of weights permanently carried on the machine in a location that poses no risk to the user. The top of the weight stack is coupled by a cable to some type of exercise implement carried on the machine, such as a lat pull down bar.

In such an exercise machine, the user adjusts the exercise mass by moving a selector pin to different vertical locations in the weight stack. This couples the weight which has been pinned and all the weights above the pinned weight to the exercise implement. Thus, when the user moves the exercise implement while performing an exercise, all of the selected weights in the weight stack are elevated to form the exercise mass. The remaining unselected weights in the lower unused portion of the weight stack simply remain stationary on the machine.

Exercise machines of this type can be single purpose machines for performing a single exercise or can be multiple purpose machines for performing multiple exercises. However, regardless of which machine is at issue, the weight stack must be quite large to allow the user to select a high exercise mass if that is what the user desires. Thus, if a user wishes to lift 200 pounds, each machine must have at least 200 pounds of weight in the weight stack even though many other users of the machine might never lift that much weight. Consequently, such exercise machines are relatively "wasteful" since they must necessarily provide a large amount of available weight even though much of this weight is never used at any given time by most users of the machine.

In addition, it is difficult to accommodate a large number of users using exercise machines alone. The number of machines determines the maximum number of users. In a system using just single purpose machines, if two users want to simultaneously use the same machine for doing the same exercise, one user must wait even though all the rest of the exercise machines might be idle. This problem can be avoided in a system in which each exercise machine is a multiple purpose machine, but each multiple purpose machine is somewhat more complex and expensive than a single purpose machine. In addition, if there are only 5 or 10 such machines in the system, then only 5 or 10 users can exercise simultaneously at one time.

Certain exercise machines have been developed that utilize a weight carried on a pivotal lever as the exercise mass. In such machines, the position of the weight can be adjusted along the lever to vary or adjust the exercise resistance provided by the exercise mass. Thus, this machine allows a greater variation in exercise resistance even though the exercise mass used on the lever might be relatively small. For example, a 25 pound weight can give more than 25 pounds of exercise resistance depending upon how far it is moved away from the pivot axis of the lever. The Paramount Direct Power machine is an example of this type of exercise machine.

However, with known pivotal lever machines, only a single user can use the machine at a given time. The slidable weight carried on the pivotal lever cannot be removed completely or in increments for use by other users. The slidable weight must remain on the exercise machine at all times.

The assignee of this invention previously made and sold an exercise machine known as the PowerBlock Gym. This machine had an exercise station at which the user could perform multiple exercises using different exercise implements. However, rather than using a conventional weight stack, the exercise mass was formed by a pair of the assignee's adjustable selectorized dumbbells known as PowerBlock dumbbells. These dumbbells were carried on a vertically sliding tray that moved up and down a rear upright of the machine.

One advantage of the PowerBlock Gym was that the selectorized dumbbells forming the exercise mass could be wholly or partially removed and used by other users even while a first user was using the Gym. For example, if one dumbbell were removed from the tray and used as a dumbbell, the second dumbbell could remain on the tray and be used as the exercise mass of the machine. Alternatively, both of the dumbbells could be partially loaded with weight and removed for use as dumbbells. The remaining unselected weights of each dumbbell, namely the weights that were not coupled to the handles of the dumbbells, would remain on the tray for use by a user of the PowerBlock Gym.

While the PowerBlock Gym theoretically expanded the numbers of users that could exercise at one time, it was not a truly effective solution to the problem of getting optimum use from the machine. For example, each PowerBlock dumbbell weighed a maximum of 85 pounds. Thus, when two fully loaded dumbbells were contained on the tray, the maximum exercise mass was 170 pounds. This is not sufficient for some users when doing some exercises. There was no way to easily and effectively increase the exercise mass.

In addition, when one dumbbell was removed or both dumbbells were partially removed for use as dumbbells, the PowerBlock Gym could still be used by another user as noted above. However, in this situation, the exercise mass was reduced by the amount of the removed mass of the dumbbells. For example, if one complete dumbbell were removed, then the maximum exercise mass decreased by 85 pounds from 170 pounds to 85 pounds. As a practical matter, the PowerBlock Gym became almost unusable if too much of the weight of the selectorized dumbbells was removed from the tray.

Finally, in the PowerBlock Gym, it could be difficult or awkward to remove the selectorized dumbbells from the tray. The tray was inclined towards the rear of the exercise machine and was located behind a rear upright. A user could dismount the machine and walk around in back of the machine to lift one of the PowerBlock dumbbells up out of the tray. However, many users found the need to dismount the machine an annoyance.

Consequently, many users tried to remove the PowerBlock dumbbells from the tray by reaching to the rear from the front of the machine. However, in its normal lowermost position, the tray carrying the dumbbells was located at least partially behind the back rest of the exercise bench. Thus, the user would have to reach over or around the back rest to get to the selectorized dumbbells.

Moreover, the upright which carried the tray was located directly in the way of the user's head. Thus, some users might hit their heads on the upright when attempting to reach the dumbbells from the front of the machine. In addition, the tray carrying the dumbbells was inclined towards the rear of the machine or away from a user attempting to reach the tray from the front of the machine. Thus, it was difficult to remove the PowerBlock dumbbells from the front of the PowerBlock Gym.

Accordingly, there is a need in the art for an exercise machine that provides an exercise mass that is adjustable to provide a wide range of exercise resistance, but that also allows multiple users to simultaneously exercise using at least some portions of the exercise mass that can be easily removed from the machine.

SUMMARY OF THE INVENTION

One aspect of this invention relates to an exercise machine which comprises an exercise station having at least one exercise implement for allowing a user to perform at least one exercise. An adjustable exercise mass assembly is provided which includes a pivotal lever carrying an exercise mass. The exercise mass comprises at least one selectorized dumbbell.

Another aspect of this invention relates to an exercise machine comprising an exercise station having at least one exercise implement for allowing a user to perform at least one exercise. An adjustable exercise mass assembly is provided which includes a pivotal lever carrying an exercise mass. The exercise mass comprises a hand weight or dumbbell system whose mass is adjustable such that at least some of the mass of the hand weight or dumbbell system can be selectively removed from the pivotal lever for use as a hand weight or dumbbell apart from the exercise machine.

An additional aspect of this invention relates to an exercise machine having at least one exercise implement for allowing a user to perform at least one exercise. An exercise mass assembly is provided which includes a pivotal lever carrying an exercise mass. The exercise station and adjustable exercise mass assembly are substantially perpendicular to one another.

Yet another aspect of this invention concerns an exercise machine having an exercise station that includes at least one exercise implement for allowing a user to perform at least one exercise. An exercise mass assembly is provided which includes a pivotal lever carrying an exercise mass. The pivotal lever is connected by an elongated flexible member to the exercise implement.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Referring first to FIGS. 1-8, a first embodiment of an exercise machine according to this invention is illustrated generally as 2. Exercise machine 2 is L-shaped and comprises an exercise station 4 and an adjustable exercise mass assembly 6. Exercise station 4 comprises one leg of the L-shaped exercise machine 2. Exercise mass assembly 6 comprises the other leg of the L-shaped exercise machine 2.

Because exercise mass assembly 6 extends substantially perpendicularly relative to exercise station 4, the user has easy access to exercise mass assembly 6 for adjusting the exercise mass and the exercise resistance provided by the exercise mass. When performing such an adjustment, the user is not significantly obstructed or interfered with by any part of exercise station 4. This will be described in more detail hereafter.

Exercise Station 4

Figure 1:
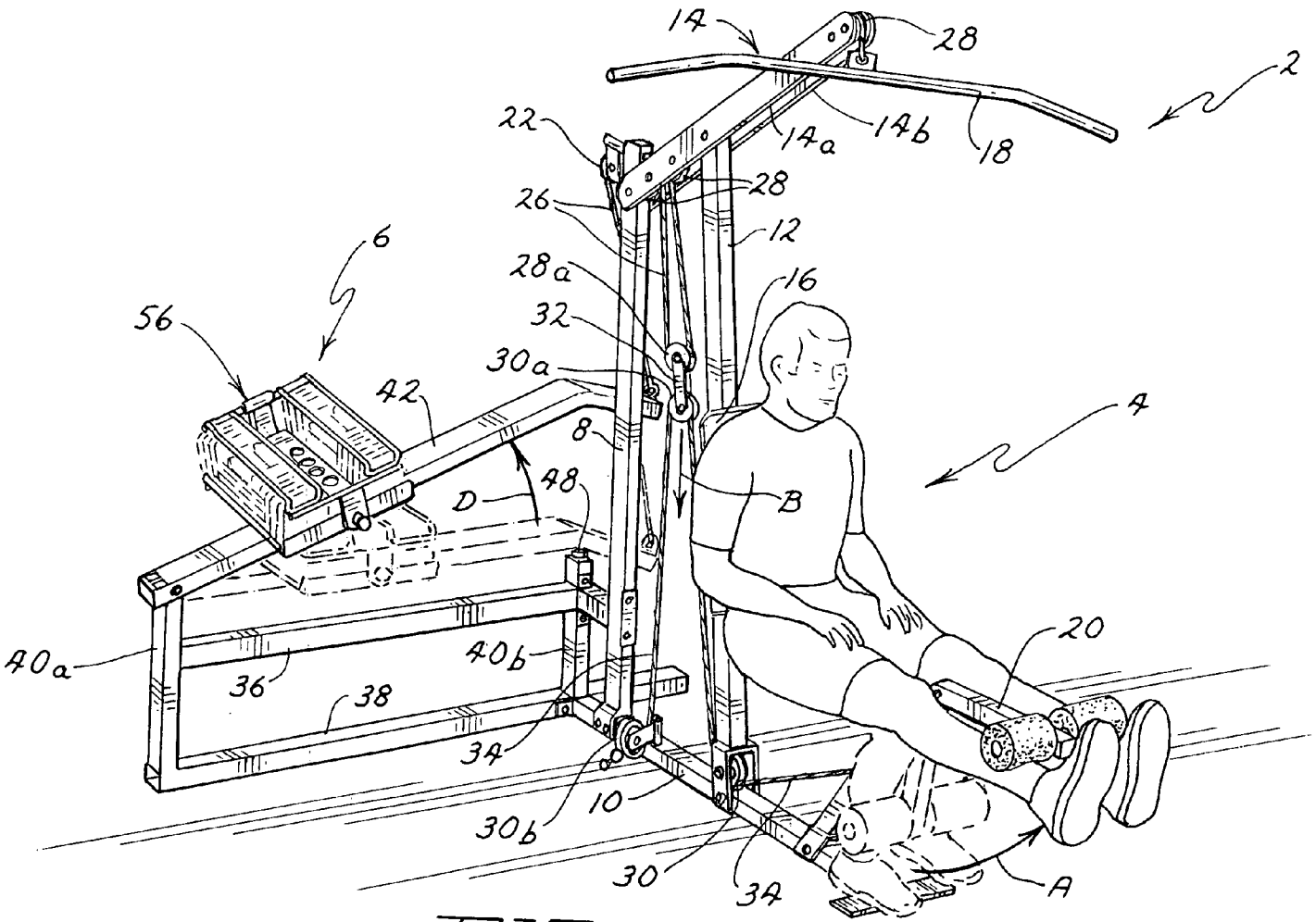
FIG. 1 is a perspective view of a first embodiment of an exercise machine according to this invention, particularly illustrating a user seated on an exercise bench of the machine performing a leg extension exercise.

Referring to FIG. 1, exercise station 4 comprises a frame made of a plurality of structural steel beams that are welded or otherwise suitably secured together. These beams comprise a rear upright 8, a base 10, and an intermediate upright 12 carried on base 10 forwardly of rear upright 8. An upper arm 14 comprising a pair of spaced plates 14*a* and 14*b* is connected to the upper ends of the rear and intermediate uprights 8 and 12. Upper arm 14 extends forwardly to terminate in a front end generally overlying the front end of base 10.

An exercise bench 16 having a back rest is carried on base 10 ahead of intermediate upright 12. Exercise bench 16 lies generally beneath the front end of upper arm 14. A user can be supported wholly or partially by exercise bench 16 while performing various exercises.

As is typical in many exercise machines, exercise station 4 is adapted for performing multiple exercises. A pull down bar 18 is suspended from the front end of upper arm 14 with pull down bar 18 overlying exercise bench 16. When seated on exercise bench 16, the user can reach up, grip and pull down on bar 18 to perform a lat pull exercise for exercising the latissimus dorsi and biceps. Similarly, pivotal roller pads 20 hang down ahead of exercise bench 16 to allow the user to perform either a leg curl exercise for exercising the hamstrings and gluteals or a leg extension for exercising the quadriceps. FIG. 1 shows the user performing a leg extension exercise.

Exercise station 4 could be adapted for performing other exercises. In addition, while it is preferred that exercise station 4 be adapted for performing multiple exercises, exercise station 4 could be designed for performing just one exercise. Thus, the exact nature and types of exercises performed at exercise station 4 is not important to this invention.

Figure 8:
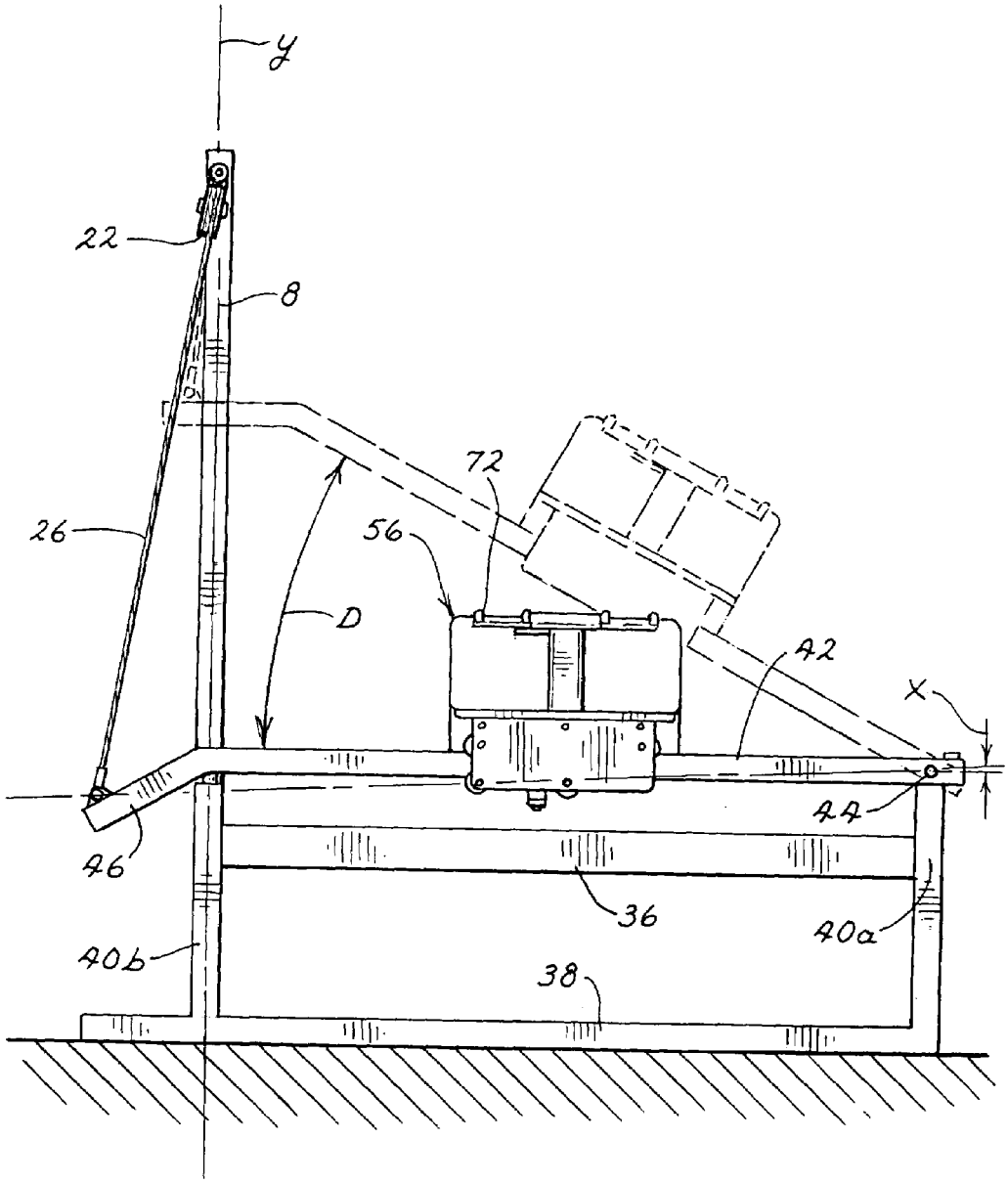
FIG. 8 is a rear elevational view of a portion of the exercise machine shown in FIG. 1, particularly illustrating the pivotal motion of the pivotal lever and the attachment point for the cable that connects to the free end of the pivotal lever.

The exercise mass provided by exercise mass assembly 6 is connected to the various exercise implements of exercise station 4 by a flexible cabling arrangement. The cabling arrangement works off of a main input pulley 22 that is carried on the back of rear upright 8 at the upper end of rear upright 8. See FIG. 8. Main input pulley 22 can be connected to rear upright 8 in a slightly cocked or canted orientation as shown in FIG. 8.

A flexible main cable 26 has its lower end connected to exercise mass assembly 6 as will be described in more detail hereafter. Main cable 26 is then entrained around various upper pulleys 28 carried on and below upper arm 14 until the front of main cable 26 is connected to pull down bar 18. When so installed, main cable 26 forms a downwardly extending loop beneath upper arm 14 as it passes around one upper pulley 28*a* located beneath upper arm 14.

The upper loop forming pulley 28*a* on which main cable 26 is entrained is part of a tandem pulley arrangement in which a lower pulley 30*a* is carried on a common support 32 beneath upper pulley 28*a*. A secondary cable 34 is then entrained around various lower pulleys 30 on base 10 and lower pulley 30*a* on the tandem pulley arrangement. The rear end of secondary cable 34 is fixed to a rear lower pulley 30*b* on base 10 to anchor the rear end of secondary cable 34. The front end of secondary cable 34 is fixed to pivotal roller pads 20. Secondary cable 34 forms an upwardly extending loop as it passes up from the rear lower pulley 30*b* over lower pulley 30*a* on the tandem pulley arrangement and then back down to the other lower pulley 30 on base 10. Thus, secondary cable 34 and main cable 26 are operationally tied together through the tandem pulley arrangement.

When the user pulls down on pull down bar 18 in a lat pull exercise, main cable 26 is simply pulled through upper pulleys 28 to elevate the lower end of main cable 26. This elevation of the lower end of main cable 26 elevates the exercise mass as will be described in more detail hereafter. When the user slowly lets up on pull down bar 18 to allow pull down bar 18 to rise, the weight of the exercise mass will pull down on main cable 26 to return the lower end of main cable 26 to its initial position.

When the user performs a leg curl or leg extension exercise as shown in FIG. 1, secondary cable 34 is tied by the tandem pulley arrangement to main cable 26 and, thus, to the exercise mass provided by exercise mass assembly 6. As shown in FIG. 1, when the user lifts up on roller pads 20 as indicated by the arrow A in FIG. 1, the front end of secondary cable 34 is pulled forwardly. Because the rear end of secondary cable 34 is anchored to base 10 of exercise station 4 and because the length of secondary cable 34 is constant, pulling the front end of secondary cable 34 forwardly can be accomplished only by pulling the tandem pulley arrangement downwardly. This is illustrated by the arrow B in FIG. 1.

As the tandem pulley arrangement is forced downwardly, it carries with it the upper loop forming pulley 28*a* around which main cable 26 is entrained. The front end of main cable 26 cannot retract because pull down bar 18 is in engagement with the front end of upper arm 14. Thus, forcing the tandem pulley arrangement downwardly can only result in lengthening the loop in main cable 26. This elevates the lower end of main cable 26 in the same manner as is accomplished by pulling down on pull down bar 18. Thus, the cabling arrangement shown herein, comprising upper pulleys 28 entraining main cable 26, lower pulleys 30 entraining secondary cable 34, and the use of a tandem pulley arrangement to couple the main and secondary cables 26 and 34 together via downwardly and upwardly extending cable loops, allows main cable 26 to lift up on the exercise mass provided by exercise mass assembly 6 regardless of which exercise is being performed.

Exercise Mass Assembly 6

The Pivotal Lever 42

Exercise mass assembly 6 provides an adjustable exercise mass attached to the lower end of main cable 26 for providing the exercise resistance against which the user exercises. Exercise mass assembly 6 comprises a rectangular truss like frame made of structural beams that are welded or bolted together. The frame of exercise mass assembly 6 comprises parallel upper and lower beams 36 and 38 joined together by side posts 40. Side posts 40 preferably extend a short distance above upper beam 36.

The frame of exercise mass assembly 6 is integrally fixed to the rear of exercise station 4 slightly behind rear upright 8. Exercise mass assembly 6 extends substantially perpendicularly to one side of exercise station 4 as shown in FIG. 1 and as described earlier herein.

Exercise mass assembly 6 includes a lever 42 that is pivotally connected to the upper end of the outer side post

40*a,* i.e. side post 40*a* that is furthest from exercise station 4. Pivotal lever 42 pivots about a substantially horizontal pivot axis 44. Pivotal lever 42 is longer than the length of upper beam 36 and terminates in a free end 46 that extends past rear upright 8 of exercise station 4 to be located on the far side of rear upright 8. Thus, as shown in FIG. 8, pivot axis 44 for pivotal lever 42 is located at quite some distance from rear upright 8 to one side of rear upright 8. However, free end 46 of pivotal lever 42 is located relatively close to rear upright 8 but on the opposite side of rear upright 8.

The main body of pivotal lever 42, namely the portion overlying upper beam 36, is arranged to be substantially horizontal and parallel to upper beam 36 when pivotal lever 42 is in its lowermost position. A rubber bumper 48 or the like is provided on the upper end of the inner side post 40*b,* i.e. on side post 40*b* that is closest to exercise station 4. Rubber bumper 48 provides a stop for pivotal lever 42 to help define the lowermost position of pivotal lever 42. Rubber bumper 48 also helps cushion the movement of pivotal lever 42 to prevent pivotal lever 42 from unduly banging against the frame of exercise mass assembly 6 if pivotal lever 42 is lowered too quickly.

Figure 5:
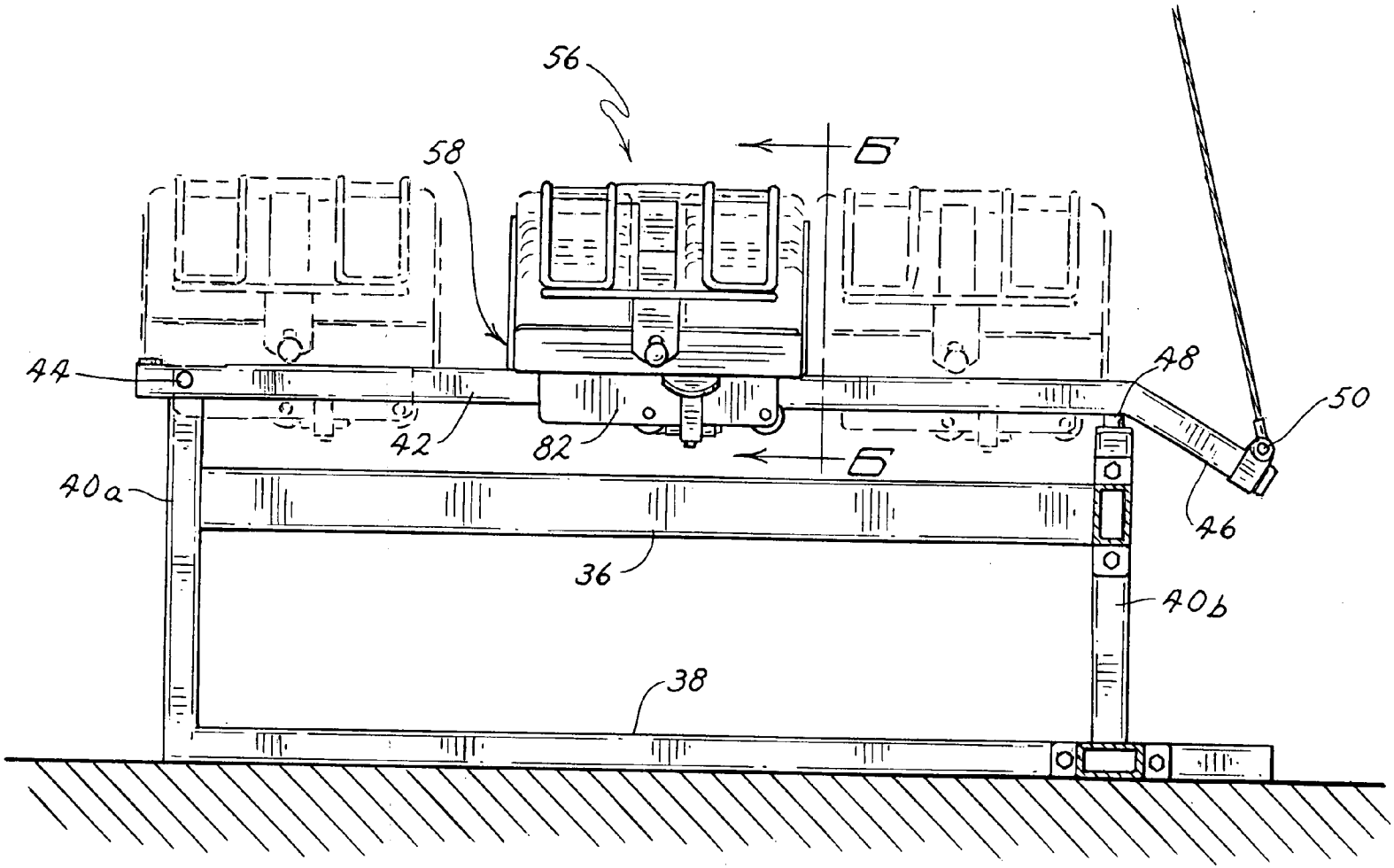
FIG. 5 is a front elevational view of a portion of the exercise machine shown in FIG. 1, particularly illustrating the tray in a plurality of adjusted positions along the length of the pivotal lever.

Free end 46 of pivotal lever 42, namely that portion of pivotal lever 42 extending past the inner side post 40*b,* is desirably angled downwardly as shown most clearly in FIGS. 5 and 8. The lower end of main cable 26 is anchored or attached to this downwardly angled free end of pivotal lever 42. Desirably, the attachment point 50 of the lower end of main cable 26 to free end 46 of pivotal lever 42 is below the level of pivot axis 44 of pivotal lever 42. Thus, pivotal lever 42 in its lowermost position effectively has a downward angle of inclination between its pivot point and attachment point 50 of main cable 26 to pivotal lever 42. This downward angle of inclination is illustrated as a in FIG. 5 and is preferably approximately 15°.

If desired, free end 46 of pivotal lever 42 could be L-shaped and extend perpendicularly downwardly relative to the main body of pivotal lever 42 rather than simply being angled downwardly as shown in FIGS. 5 and 8. The use of an L-shaped free end 46 on pivotal lever 42 with the L-shape pointing downwardly would more easily allow attachment point 50 between main cable 26 and pivotal lever 42 to be low enough relative to pivot axis 44.

Figure 2:
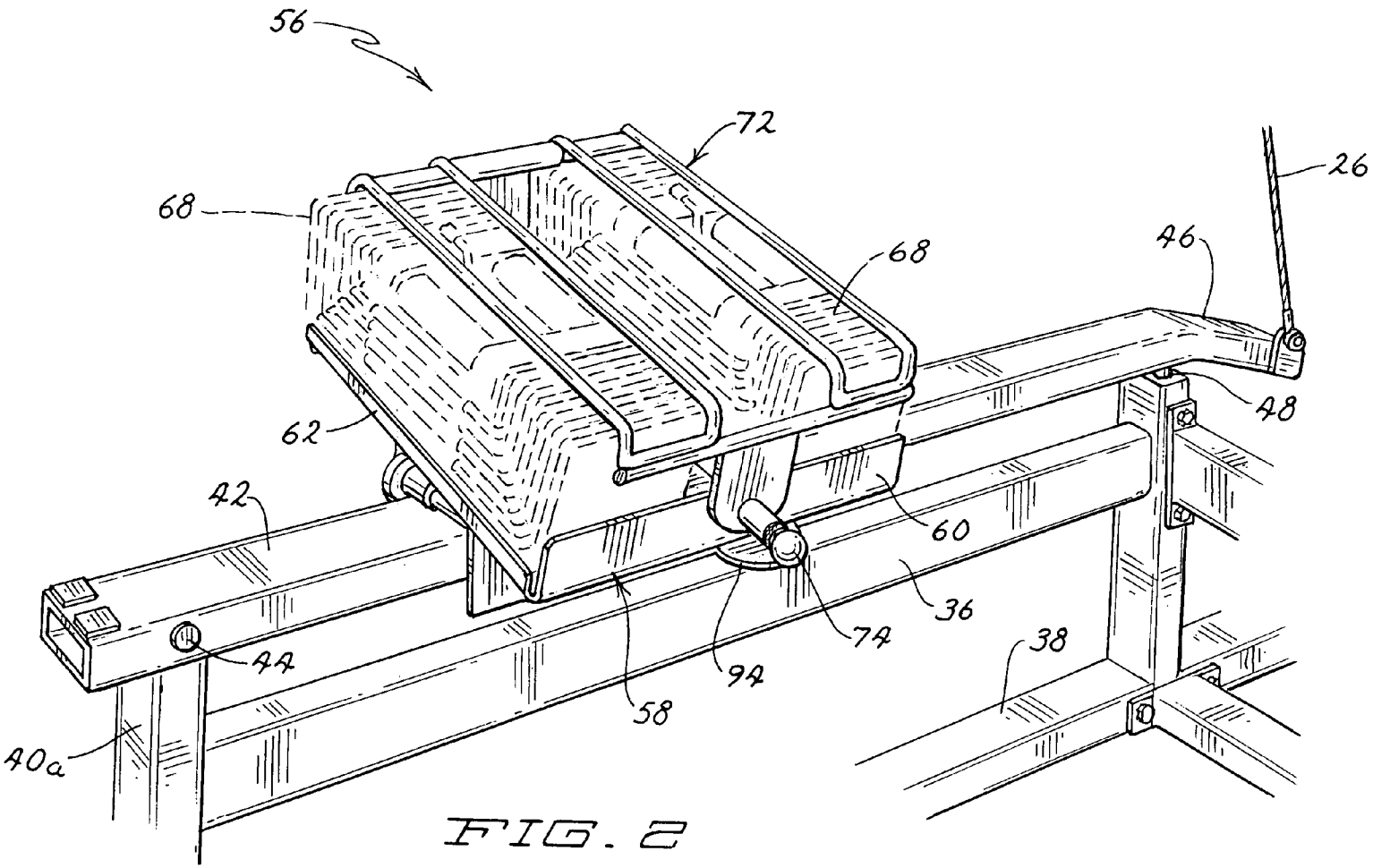
FIG. 2 is an enlarged perspective view of a portion of the exercise machine shown in FIG. 1, particularly illustrating a slidable tray located on a pivotal lever with the tray being adapted to carry a pair of selectorized dumbbells shown in phantom in FIG. 2.
Figure 4:
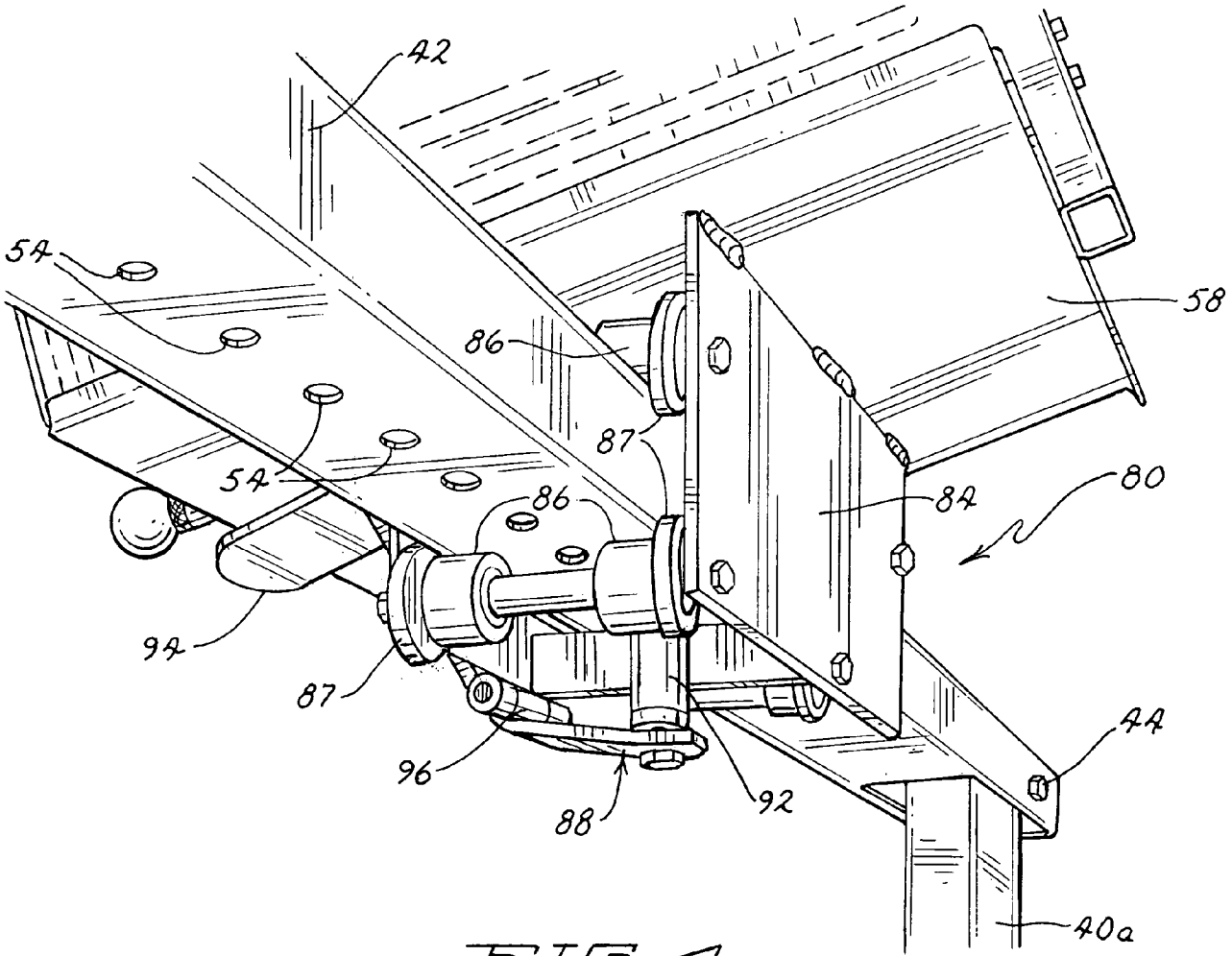
FIG. 4 is an enlarged perspective view of the underside of the tray shown in FIG. 2, particularly illustrating a wheeled truck for slidably supporting the tray on the pivotal lever and showing the underside of the pivotal lever including a plurality of spaced locking holes therein.

As shown in FIGS. 2 and 4, pivotal lever 42 comprises a tubular, rectangular beam similar to the tubular upper and lower beams 36 and 38 used to construct the frame of exercise mass assembly 6. A plurality of spaced locking holes 54 are provided on the underside of pivotal lever 42 along most of the length of the main body of pivotal lever 42. Some of these locking holes 54 are shown in FIG. 4. The purpose of locking holes 54 will be described in more detail hereafter.

The Adjustable Exercise Mass 56

An exercise mass 56 is adjustably carried on pivotal lever 42 for a sliding motion along most of the length of the main body of pivotal lever 42. Exercise mass 56 includes a weight carrying support or tray 58 that is sloped or angled relative to the horizontal. See FIG. 3. Thus, tray 58 has a lower front side that includes a relatively short, upwardly extending front wall 60. Tray 58 includes a higher rear side that is open and without a similar rear wall. In addition, tray 58 includes two relatively short side walls 62 along each side of tray 58 between the front and rear sides of tray 58.

Figure 3:
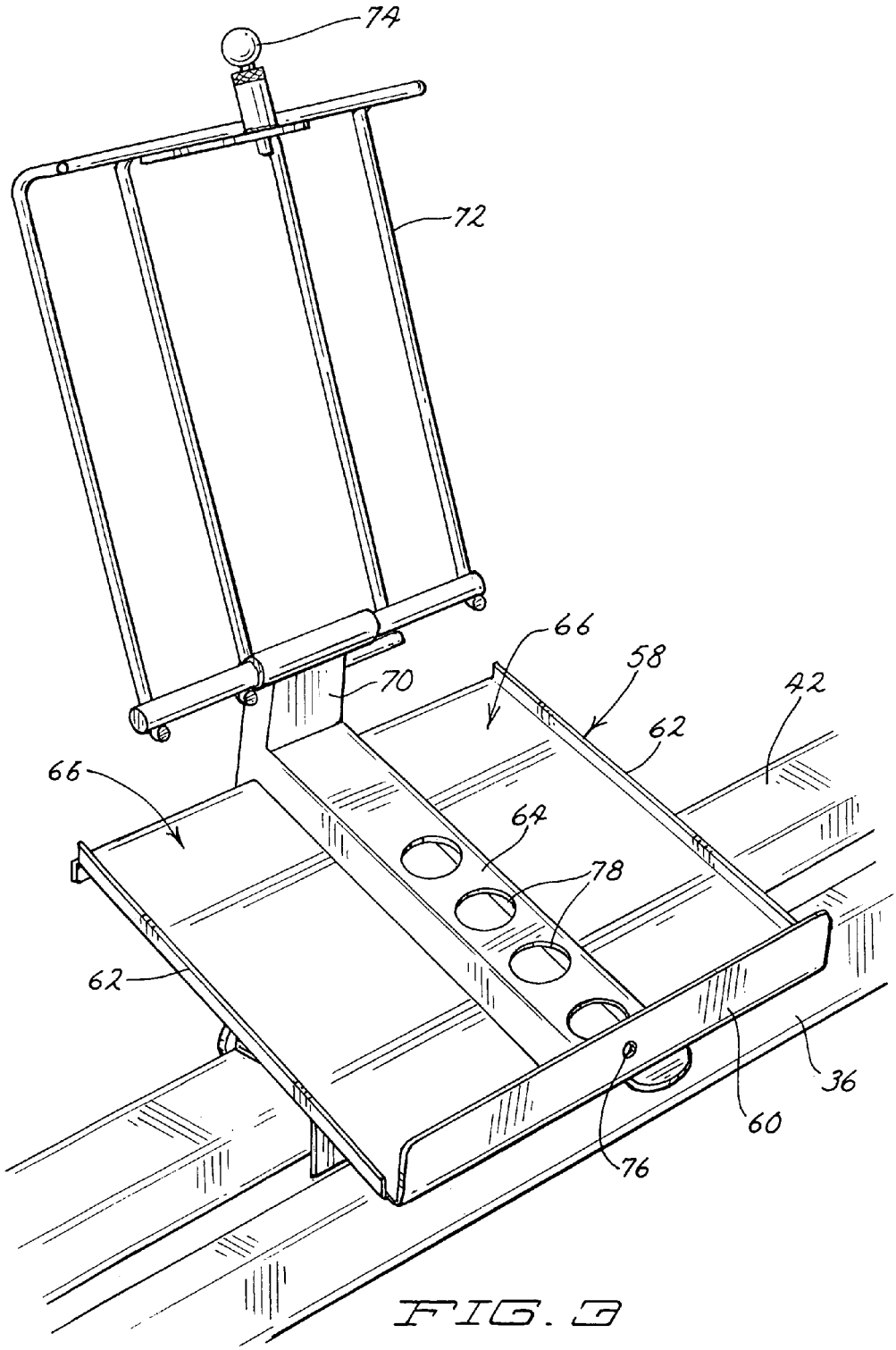
FIG. 3 is an enlarged perspective view of the tray shown in FIG. 2, particularly showing the tray being empty of dumbbells and with a pivotal cover on the tray being swung upwardly relative to the tray to open the tray to permit insertion of the selectorized dumbbells into the tray.

As shown in FIG. 3, tray 58 includes a center partition 64 that divides tray 58 into left and right weight receiving cavities 66. Each cavity 66 is sized to hold a selectorized dumbbell 68 therein. More particularly, each cavity 66 is designed for use with a dumbbell 68 known as the PowerBlock which is manufactured and sold by Intellbell, Inc. of Owatonna, Minn. The PowerBlock dumbbell is also disclosed more fully in U.S. Pat. No. 5,637,064, which is hereby incorporated by reference.

In a selectorized dumbbell 68 like the PowerBlock Dumbbell, a selector is provided which can be moved by the operator between different positions to "select" or couple different numbers of weights to the handle of the dumbbell. The weights are nested together and form a pair of spaced apart stacks of weight plates. The handle can be inserted between the stacks of weight plates prior to a weight selection operation. After a particular selection is made through movement of the selector and the user lifts the dumbbell, the handle carries with it only the weights selected by the user leaving behind the other weights. This is the general type of dumbbell 68 that is preferably carried in each cavity 66 in tray 58. Selectorized dumbbells 68 are shown in the drawings only in phantom so as not to obscure tray 58 and because such selectorized dumbbells 68 are themselves well known.

While cavities 66 in tray 58 have been particularly shaped and designed for holding PowerBlock selectorized dumbbells 68, cavities 66 could be designed for use with other selectorized dumbbells or even with non-selectorized hand weights or dumbbells. For example, tray 58 could be designed for holding a rack or dumbbell tree on which a plurality of traditional hand weights or cast iron dumbbells (5 lbs., 15 lbs. 25 lbs. etc.) are releasably stored. However, it is preferred that tray 58 carry some type of selectorized dumbbell 68. In addition while a pair of cavities 66 has been shown for holding a pair of selectorized dumbbells 68, the number of cavities 66 in tray 58 and the number of dumbbells 68 carried by tray 58 could be increased or decreased.

Center partition 64 of tray 58 includes an upwardly extending rear post 70. A pivotal cover 72 is pivoted to the upper end of rear post 70 to allow pivotal cover 72 to be opened as shown in FIG. 3 or closed as shown in FIG. 2. When pivotal cover 72 is open as shown in FIG. 3, the weight receiving cavities 66 in tray 58 are open and can be accessed for inserting and removing selectorized dumbbells 68 from cavities 66. When pivotal cover 72 is closed as shown in FIG. 2, pivotal cover 72 extends over the top of selectorized dumbbells 68 to retain selectorized dumbbells 68 within cavities 66 formed in tray 58. The front of pivotal cover 72 can be locked to front wall 60 of tray 58 by a conventional spring biased, pull type locking pin 74 received in a hole 76 in front wall 60 of tray 58.

While pivotal cover 72 has been shown as being formed from a plurality of spaced rods or bars rigidly connected together in a grate-like manner, pivotal cover 72 could have any appropriate construction or shape.

If desired, center partition 64 of tray 58 can also have a plurality of small circular bores 78 along the length thereof. Each circular bore 78 can receive and store one small supplemental circular weight (not shown) in a weight increment different from the weights normally provided by selectorized dumbbells 68 themselves. For example, if selectorized dumbbells 68 are adjustable only in 5 or 10 pound increments, the supplemental weights stored in bores 78 could be provided in 2.5 pound increments. These supplemental weights are selectively installable in the PowerBlock dumbbells in a known manner.

Figure 6:
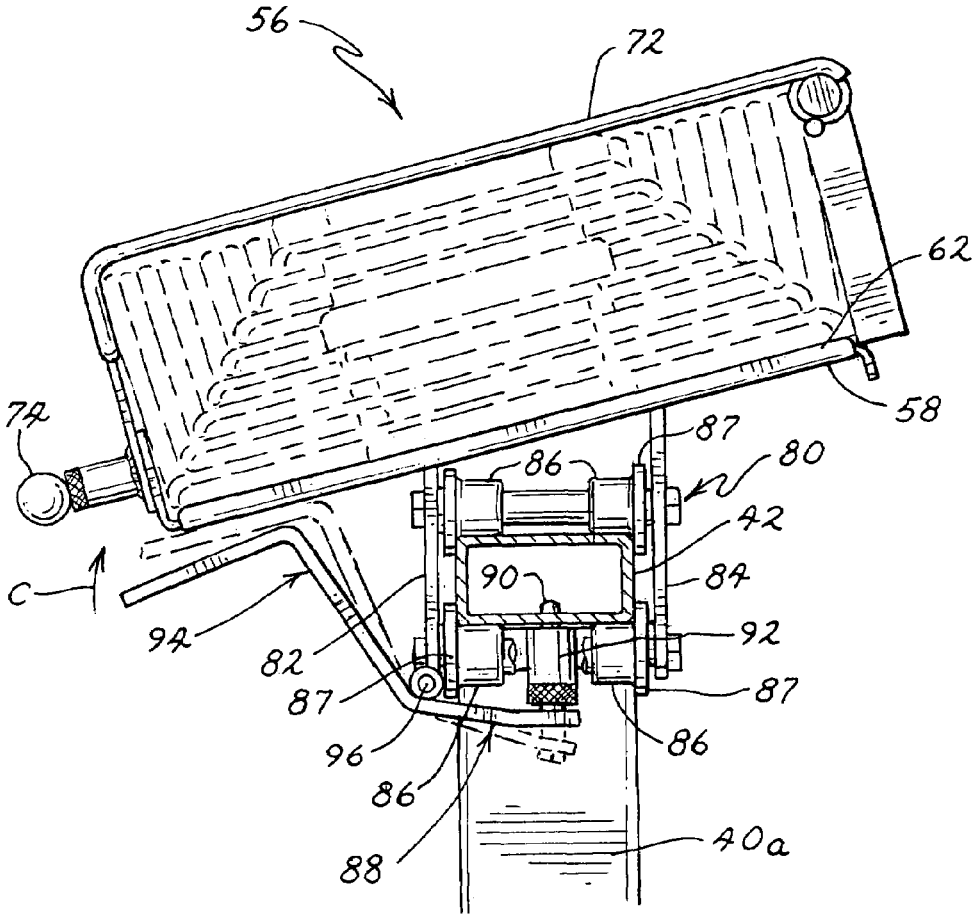
FIG. 6 is a cross-sectional view through the pivotal lever of the exercise machine taken along lines 6-6 in FIG. 5, particularly illustrating the tray from one side and showing the latch for locking the tray in place in an adjusted position along the length of the lever.
Figure 7:
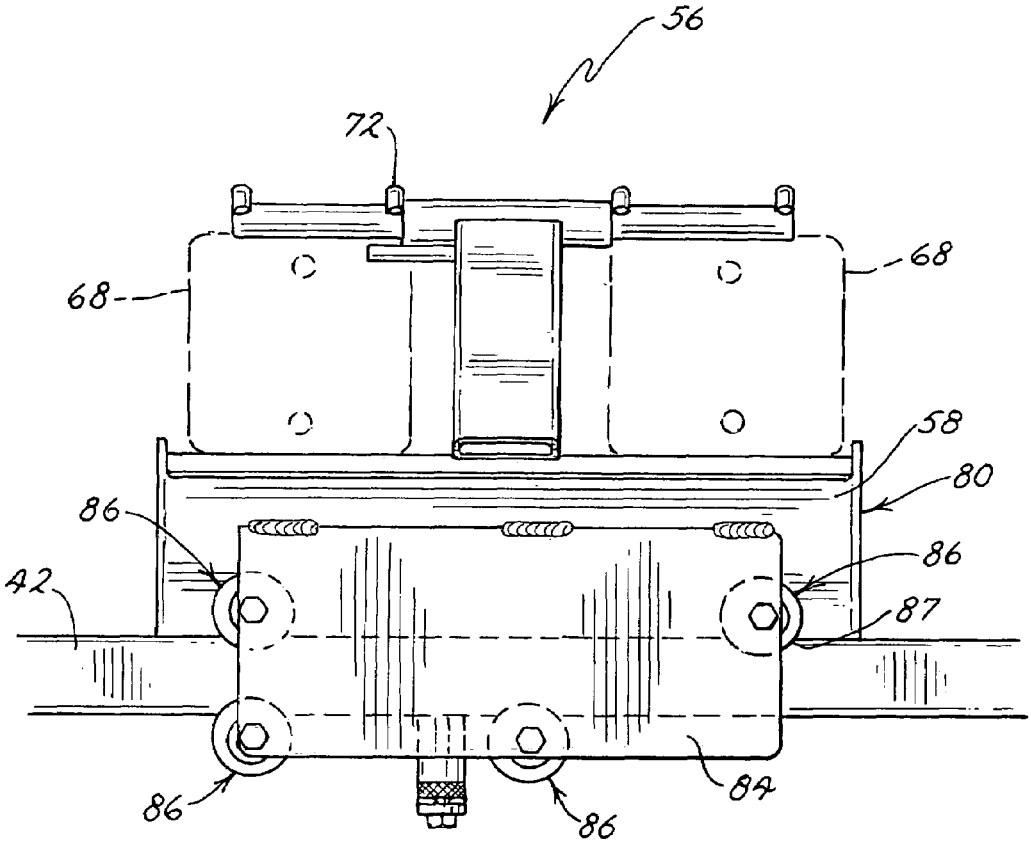
FIG. 7 is an enlarged rear elevational view of the tray shown in FIG. 2.

Tray 58 is slidable along the length of pivotal lever 42 to provide adjustability of the exercise resistance provided by whatever exercise mass 56 is present on tray 58. This is accomplished by placing a wheeled truck 80 on the underside of tray 58 as best shown in FIGS. 4 and 6. Wheeled truck 80 includes spaced front and rear flanges 82 and 84 that have their upped edges welded to the underside of tray 58. Because tray 58 is desirably sloped towards the front as described earlier, front flange 82 is shorter than rear flange 84 to provide the desired slope in tray 58. See FIG. 6.

Various sets of rollers or wheels 86 are provided on wheeled truck 80 extending between the flanges of wheeled truck 80. Some of the sets of wheels 86 roll along the top of pivotal lever 42 while other sets of wheels 86 roll along the bottom of pivotal lever 42. Wheels 86 desirably have side rims 87 that extend a short distance along the sides of pivotal lever 42 to help align and guide wheels 86 as they roll along pivotal lever 42. Thus, wheeled truck 80 carried on the bottom of tray 58 allows tray 58 to smoothly roll back and forth on pivotal lever 42.

A latch 88 is provided on wheeled truck 80 to lock tray 58 in place in an adjusted position along pivotal lever 42. Latch 88 comprises a conventional spring biased locking pin 90 mounted in a housing 92 that is carried on a cross wall of wheeled truck 80. When locking pin 90 is extended upwardly out of housing 92 by a spring (not shown) carried within housing 92, locking pin 90 enters into one of the locking holes 54 on the underside of pivotal lever 42 to lock tray 58 to pivotal lever 42. See FIG. 6 for an illustration of locking pin 90 extended up through a locking hole. When locking pin 90 is retracted within housing 92 against the bias of the spring, locking pin 90 clears the locking holes 54. Tray 58 can then be slid along pivotal lever 42 to a new position.

A pivotal release member 94 is carried on wheeled truck 80 to release locking pin 90. Release member 94 pivots about a pivot axis 96 carried on the lower side of the front flange 82 of wheeled truck 80. The rear end of release member 94 engages around a lower head of locking pin 90 as shown in FIGS. 4 and 6. The front end of release member 94 is generally L-shaped and terminates slightly forwardly of the front side of tray 58 beneath tray 58 as best shown in FIG. 6.

Referring further to FIG. 6, release member 94 is normally in its solid line position corresponding to the position in which tray 58 is locked. If the user wishes to reposition tray 58, the user simply puts the fingers of one hand beneath the front end of release member 94 and pushes upwardly on release member 94 towards the bottom of tray 58 as indicated by the arrow C in FIG. 6. This action is shown in phantom in FIG. 6 and pivots release member 94 about the horizontal pivot axis 96 to move the rear end of release member 94 downwardly. The rear end of release member 94 then pulls downwardly on the head of locking pin 90 to pull locking pin 90 free of the locking hole 54 with which it was engaged.

Following unlocking of locking pin 90 and while keeping the front end of release member 94 elevated, the user is then free to slide tray 58 to a new position along the length of pivotal lever 42. When a desired new position is reached, the user can simply remove his or fingers from underneath release member 94. The spring biasing on locking pin 90 will cause locking pin 90 to be extended upwardly out of its housing to reenter a new locking hole 54. If locking pin 90 and the new locking hole 54 are not perfectly aligned with one another, the user need only incrementally move tray 58 until locking pin 90 does align with the new locking hole 54 and locking pin 90 clicks into place. Thus, a positive latch 88 is used between tray 58 and pivotal lever 42 for locking tray 58 in an adjusted position along the length of pivotal lever 42.

The Operation of Exercise Machine 2

In using the embodiment of exercise machine 2 disclosed in FIGS. 1-7, the user can perform many common exercises such as a lat pull, leg curls, leg extensions, etc. When doing so, the exercise implement being used, whether it be pull down bar 18 or roller pads 20 or some other implement, ultimately pulls up on main cable 26 attached to free end 46 of pivotal lever 42. This causes pivotal lever 42 to pivot upwardly about its pivot axis, as illustrated by the arrow D in FIGS. 1 and 8, to provide exercise resistance. The actual amount of exercise resistance provided is determined by the weight of the exercise mass 56 and by the position of exercise mass 56 along the length of pivotal lever 42.

Exercise machine 2 of this invention is extremely efficient in how it uses the weight provided by selectorized dumbbells 68 placed on tray 58. For one thing, each selectorized dumbbell 68 can do double duty. One user might wish to use one dumbbell 68 for exercise apart from exercise machine 2 while another user can still use exercise machine 2 with just one dumbbell 68 carried on tray 58. The second user can compensate for the loss of the mass of the first dumbbell 68 by sliding tray 58 further away from the pivot axis 44 of pivotal lever 42 to increase the pivotal lever arm and thus increase the exercise resistance provided by the remaining exercise mass 56.

Thus, at any given time, most if not all of the weight provided by the pair of adjustable dumbbells 68 can be in use by multiple users. This is an attractive cost savings feature to commercial exercise establishments wishing to keep the capital costs of their equipment as low as possible. The price of steel and cast iron weights has dramatically increased in recent times. Thus, by being efficient in using weight and by not tying up large amounts of weight in captive weight stacks, exercise machine 2 of this invention keeps the cost of the weight used as low as possible.

In fact, the efficiency provided by exercise machine 2 of this invention goes further than that. Since two selectorized dumbbells 68 are carried on tray 58, two users might decide to use the handles of each of the two dumbbells with some but not all of the possible weights connected to the handles. However, this would still leave a portion of the nested weights from each dumbbell, i.e. the weights that were not selected by either of the first two users, in place on tray 58. Thus, a third user could still use exercise machine 2 to exercise while simply sliding tray 58 back and forth on pivotal lever 42 as needed to find an appropriate exercise resistance.

In addition, as described above, the support or tray 58 could be designed to carry a rack or tree on which a plurality of conventional hand weights or cast iron dumbbells would be carried. This would allow some users to remove some of these hand weights or dumbbells for use as hand weights or dumbbells while leaving the other hand weights or dumbbells in place on the rack or tree. Thus, this invention is not limited to using only selectorized dumbbells as the slidable exercise mass 56, though use of such selectorized dumbbells is preferred.

Exercise machine 2 of this invention provides an optimum exercise experience for the user. For example, as noted earlier, it is preferred that attachment point 50 of main cable 26 to free end 46 of pivotal lever 42 be lower than pivot axis 44. See FIG. 8. If attachment point 50 were at the same elevation or higher than pivot axis 44, the exercise resistance would tend to fall off sharply as pivotal lever 42 rises. But, by having a starting position in which attachment point 50 of main cable 26 is lower than pivot axis 44 of pivotal lever 42, the exercise resistance provided by exercise mass 56 on pivotal lever 42 remains much more constant over a given range of motion.

In addition, referring further to FIG. 8, attachment point 50 of main cable 26 to free end 46 of pivotal lever 42 is on the side of rear upright 8 that is opposite to the side of rear upright 8 on which pivot axis 44 of pivotal lever 42 is located. Thus, as main cable 26 is elevated in an exercise motion, attachment point 50 moves closer to rear upright 8 and to a vertical plane passing downwardly from the top of the main input pulley 22 to the ground. Such a vertical plane is illustrated as y in FIG. 8. This has additionally been found to improve the feel of the exercise compared to the situation where the starting position of attachment point 50 prior to elevation of pivotal lever 42 is aligned with vertical plane y such that attachment point 50 only moves away from plane y.

Preferably, as shown in FIG. 8, exercise machine 2 is designed such that attachment point 50 never crosses vertical plane y. Alternatively, exercise machine 2 could be designed such that attachment point 50 crosses vertical plane y only in the last portion of the range of motion for the exercise, e.g. only in the last 20% to 30% of the range of motion of the exercise. Thus, having the cable attachment point simply move closer to the vertical plane y, especially during the early portions of the range of motion of the exercise, enhances the feel of the exercise to the user.

In addition, the length of the pivotal lever arm of pivotal lever 42 is the distance between pivot axis 44 of pivotal lever 42 and attachment point 50 of main cable 26 to pivotal lever 42. The initial length of main cable 26 between main input pulley 22 and attachment point 50 when pivotal lever 42 is in its lowermost position effects the angular range of motion of pivotal lever 42 arm. If pivotal lever arm of pivotal lever 42 is short and the initial length of main cable 26 is long, pivotal lever 42 will have a large angular motion as the user does a particular exercise. Applicants have found that it is desirable that the angular motion of pivotal lever 42 arm not exceed approximately 40° because the exercise resistance will begin to fall off sharply after that.

Exercise machine 2 of this invention is designed to keep the maximum angular motion of pivotal lever 42 arm at approximately 40° or less by keeping the length of pivotal lever 42 arm relatively long compared to the initial length of main cable 26. Desirably, the pivotal lever arm or pivotal lever 42 will exceed 50% of the initial length of main cable 26. If this ratio is observed, the user can exercise through a full range of motion on exercise machine 2 without pivotal lever 42 moving through more than approximately 40°. This also keeps the exercise resistance more constant.

Thus, three design criteria have been described above that provide the most constant exercise resistance or contribute to providing a good feel to the user during exercise. These criteria comprise having attachment point 50 to pivotal lever 42 begin below pivot axis 44 of pivotal lever 42, having attachment point 50 to pivotal lever 42 move closer to the vertical plane y through main input pulley 22 as pivotal lever 42 rises, and having the length of pivotal lever 42 be proportioned relative to the initial length of main cable 26 to limit the angular motion of pivotal lever 42 to a maximum of approximately 40°.

These three criteria are cumulative in effect, but they need not be used cumulatively in exercise machine 2 of this invention, or even at all. Exercise machine 2 of this invention would still be useful in its economical use of weights and of the simultaneous use of portions of the selectorized dumbbells 68 on tray 58 while the dumbbells 68 are also being used as dumbbells even if none of the aforementioned three design criteria are used in exercise machine 2.

The L-shaped design of exercise machine 2 with exercise mass assembly 6 being substantially perpendicular to exercise station 4 creates a rigid, stable structure due to the roughly equal lengths of exercise mass assembly 6 relative to exercise station 4. This L-shaped design also fits neatly into a corner if so desired. Nonetheless, because selectorized dumbbells 68 and tray 58 slide back and forth along pivotal lever 42, a user can approach tray 58 from the front of exercise machine 2 for easy access to tray 58 and to the selectorized dumbbells 68 carried by tray 58. The user need not approach tray 58 from the back, thus allowing the rear of exercise machine 2 to be positioned close to a wall if so desired.

Exercise mass assembly 6 could be arranged to be parallel to exercise station 4 if so desired. In such a case, free end 46 of pivotal lever 42 would stick rearwardly past rear upright 8 and pivot axis 44 would be arranged forwardly of rear upright 8. Main input pulley 22 would be reoriented on rear upright 8 so that main cable 26 would still pass smoothly up over main input pulley 22. The three design criteria noted above could still be used on such an exercise machine 2. If a parallel arrangement of exercise mass assembly 6 relative to exercise station 4 were used, then the user could reposition exercise mass 56 along pivotal lever 42 from a seated position on exercise bench 16.

The Coverless Tray

Figure 9:
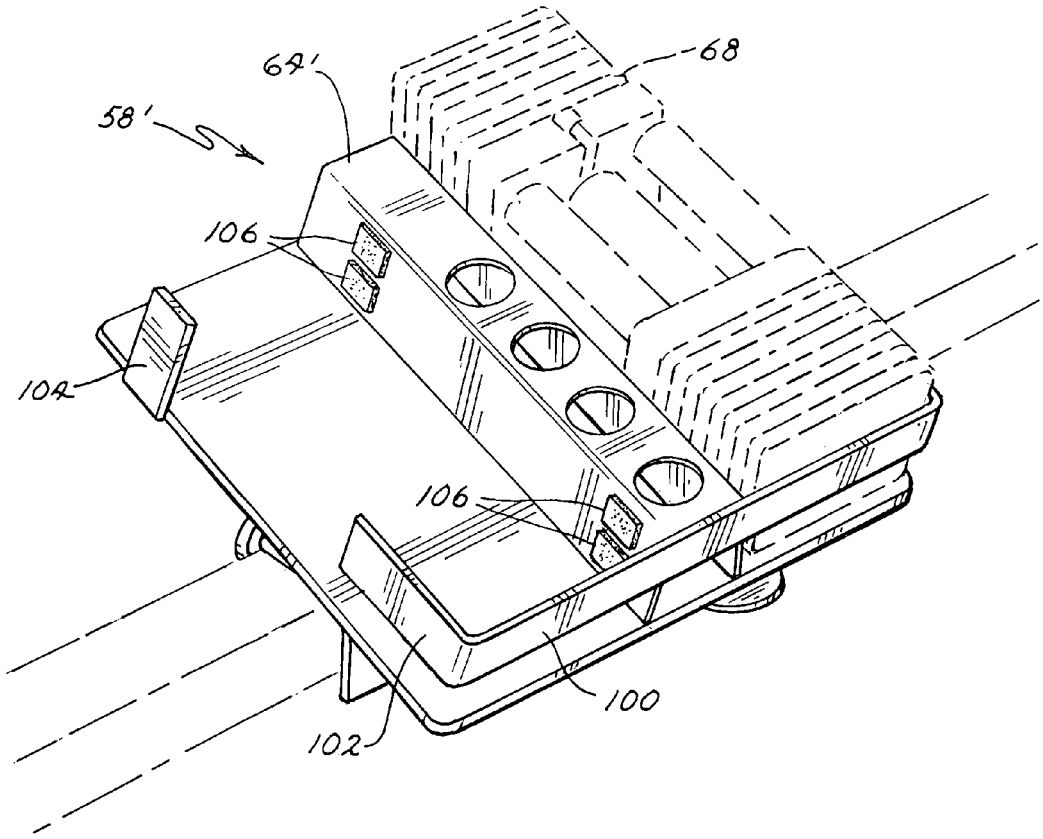
FIG. 9 is a perspective view of an alternative embodiment of the sliding tray.

As described earlier, in the first embodiment of exercise machine 2 shown in FIGS. 1-8, tray 58 is provided with a pivotal cover 72 for retaining selectorized dumbbells 68 within cavities 66 provided in tray 58. FIG. 9 shows an alternative tray 58' that has no such cover with one of cavities 66' in tray 58' being empty and with the other cavity being filled with a selectorized dumbbell.

In the alternative tray, a plurality of retaining walls are provided along the front and the sides of each cavity 66'. This includes a front wall 100 secured to the front of center partition 64'. A side wall 102 extends rearwardly along the side of cavity 66' from the outer end of front wall 100. Side wall 102 could continue back along the entire side of cavity 66' if so desired. Alternatively, as shown, a second side wall 104 spaced from the first side wall 102 could be used towards the top or rear of cavity 66'. Cavity 66' is open at the back.

The center partition 64' of tray 58' and the front and side walls 100, 102 and 104 thereon are higher than in tray 58 shown in FIGS. 1-8. They extend about as twice as high relative to the bottom wall of tray 58' as in the first embodiment of tray 58. In addition, the facing surfaces of center partition 64' and the side walls 102 and 104 are provided with rubber glides 106. Selectorized dumbbell 68 can be dropped down into cavity 66' from above or from the rear with rubber glides 106 abutting closely against the sides of selectorized dumbbell 68. Basically, the design of tray 58' shown in FIG. 9 simply relies on a snug fit between each selectorized dumbbell 68 and the cavity 66' to retain selectorized dumbbell 68 therein.

When using a tray 58' without the pivotal cover 72, pivotal lever 42 should not move more than approximately 50°. If the angular motion of pivotal lever 42 exceeds approximately 50°, there is a danger that one or more of the selectorized dumbbells 68 could fall out of tray 58'. Thus, some type of stop is desirably utilized when the coverless tray 58' is used to positively prevent pivotal lever 42 from pivoting more than approximately 50°. Such a stop could comprise a flexible strap or tether (not shown) extending between upper beam 36 of the frame of exercise mass assembly 6 and pivotal lever 42.

Various other modifications of this invention will be apparent to those skilled in the art. While cables 26 and 34 have been disclosed as connecting pivotal lever 42 to the exercise implements, any suitable elongated flexible members, including belts, could be used. Accordingly, the scope of this invention will be limited only by the appended claims.

We claim:

1. An exercise machine, which comprises:

(a) an exercise station having at least one exercise implement for allowing a user to perform at least one exercise;

(b) an adjustable exercise mass assembly which includes a pivotal lever that pivots about a pivot axis, wherein the pivotal lever is operatively coupled to the exercise implement, wherein the pivotal lever carries an exercise mass to provide an exercise resistance for the exercise implement, wherein the exercise mass comprises at least one selectorized dumbbell; and (c) wherein the selectorized dumbbell is movable relative to the pivotal lever towards the pivot axis to decrease the exercise resistance for the exercise implement and away from the pivot axis to increase the exercise resistance for the exercise implement.

2. The exercise machine of claim 1, wherein the selectorized dumbbell is releasably carried on a support on the pivotal lever.

3. The exercise machine of claim 2, wherein the support comprises an upwardly facing tray.

4. The exercise machine of claim 2, wherein the support is movable back and forth along the pivotal lever to adjust the exercise resistance provided by the selectorized dumbbell.

5. The exercise machine of claim 4, further including a latch for locking the support to the pivotal lever after the position of the support has been adjusted along the pivotal lever.

6. The exercise machine of claim 2, wherein the support includes an openable and closable cover for allowing a selectorized dumbbell to be placed in and removed from the support when the cover is open and for retaining the selectorized dumbbell in the support when the cover is closed.

7. The exercise machine of claim 2, wherein the support is open from above without a cover to allow the selectorized dumbbell to be dropped into the support.

8. The exercise machine of claim 7, further including a stop for limiting maximum pivotal motion of the pivotal lever.

9. The exercise machine of claim 2, wherein the support includes a pair of cavities for releasably holding a pair of selectorized dumbbells.

10. The exercise machine of claim 9, wherein the support has a central partition with each cavity being contained between each side of the central partition and one side of the support.

11. The exercise machine of claim 2, wherein the selectorized dumbbell has a plurality of weight plates on either end of a handle, the selectorized dumbbell having a selector for allowing a user to select a desired number of weight plates to be coupled to either end of the handle to allow the user to vary the weight carried by the handle, and wherein the user may further adjust the exercise mass by positioning the selector following placement of the dumbbell in the support to leave behind in the support at least some of the weight plates after removal of the selectorized dumbbell from the support such that the weight plates left behind in the support form the exercise mass.

12. The exercise machine of claim 1, wherein the exercise station and the exercise mass assembly are substantially perpendicular to one another.

13. The exercise machine of claim 12, wherein the selectorized dumbbell is releasably carried on the pivotal lever and is removable and replaceable on the pivotal lever from a front side of the pivotal lever as the user stands to one side of the exercise station.

14. The exercise machine of claim 13, wherein the selectorized dumbbell is carried on an upwardly facing support provided on the pivotal lever, wherein the support is angled or inclined downwardly toward the front side of the pivotal lever.

15. The exercise machine of claim 1, wherein the exercise station and the exercise mass assembly are connected to one another.

16. The exercise machine of claim 1, wherein the exercise implement is coupled to the pivotal lever by an elongated flexible member.

17. The exercise machine of claim 16, wherein the flexible member attaches to the pivotal lever at an attachment point and extends from the attachment point upwardly over a main input pulley carried on the exercise station, wherein the flexible member attachment point when the pivotal lever is in a lowermost position is displaced to one side of a vertical plane passing through a top of the main input pulley.

18. The exercise machine of claim 17, wherein the flexible member attachment point and a pivot axis of the pivotal lever are located relative to one another and to the main input pulley such that the flexible member attachment point moves closer to the vertical plane as the pivotal lever is pivoted upwardly by the flexible member.

19. The exercise machine of claim 18, wherein the flexible member attachment point does not cross over the vertical plane over a full range of motion of the pivotal lever.

20. The exercise machine of claim 16, wherein the pivotal lever is pivoted to the exercise mass assembly at a pivot point, and wherein the flexible member attaches to the pivotal lever at a horizontal elevation that is lower than the elevation of the pivot point.

21. The exercise machine of claim 20, wherein the pivotal lever has a main body that is substantially horizontal when the pivotal lever is in a lowermost position on the exercise mass assembly, and wherein the pivotal lever has a free end that is depressed relative to the main body of the pivotal lever with the flexible member being attached to the depressed free end of the pivotal lever so as to be attached to the pivotal lever at an elevation lower than the elevation of the pivot point.

22. An exercise machine, which comprises:

(a) an exercise station having at least one exercise implement for allowing a user to perform at least one exercise;

(b) an adjustable exercise mass assembly that provides an exercise resistance for the exercise implement, wherein the exercise mass assembly includes a pivotal lever carrying an exercise mass, wherein the exercise mass comprises a hand weight or dumbbell system whose mass is adjustable such that at least a portion of the mass of the hand weight or dumbbell system can be selectively attached to the pivotal lever; and (c) wherein the hand weight or dumbbell system is movable back and forth on the pivotal lever towards and away from a pivot axis of the pivotal lever in a manner that adjusts the exercise resistance provided by the portion of the mass of the hand weight or dumbbell system that is carried on the pivotal lever.

23. The exercise machine of claim 22, wherein the hand weight or dumbbell system comprises at least one selectorized dumbbell movably carried on the pivotal lever.

24. An exercise machine, which comprises:

(a) an exercise station having at least one exercise implement for allowing a user to perform at least one exercise, wherein the exercise station has an elongated floor engaging base that extends in a first direction along the floor; and (b) an adjustable exercise mass assembly which includes a pivotal lever carrying an exercise mass, wherein the exercise mass comprises a selectorized dumbbell, wherein the pivotal lever pivots about a substantially horizontal pivot axis such that the pivotal lever moves within a vertical pivot plane as the pivotal lever pivots, and wherein the first direction of the floor engaging base of the exercise station and the vertical pivot plane of the pivotal lever of the adjustable exercise mass assembly are disposed in a substantially fixed perpendicular orientation to one another and remain in the fixed perpendicular orientation as the pivotal lever pivots up and down within the vertical pivot plane.

25. The exercise machine of claim 24, wherein the exercise mass is releasably carried on the pivotal lever and is removable and replaceable on the pivotal lever from a front side of the pivotal lever as the user stands to one side of the exercise station.

26. An exercise machine, which comprises:

(a) an exercise station having at least one exercise implement for allowing a user to perform at least one exercise, wherein the exercise station includes a main input pulley;

(b) an exercise mass assembly which includes a pivotal lever carrying an exercise mass, wherein the pivotal lever is connected by an elongated flexible member to the exercise implement, wherein the flexible member is attached to the pivotal lever at an attachment point and extends upwardly there-from around the main input pulley with the flexible member then extending from the main input pulley to eventually connect to the exercise implement; and (c) wherein the main input pulley and that portion of the flexible member extending therefrom to the pivotal lever are in a vertically canted or cocked orientation on one side of a vertical plane that would contain the main input pulley if the main input pulley were hanging straight downwardly, the cocked or canted orientation being present when the pivotal lever is in a lowermost position such that the attachment point of the flexible member to the pivotal lever is displaced to one side of the vertical plane.

27. The exercise machine of claim 26, wherein the flexible member attachment point and a pivot axis of the pivotal lever are located relative to one another and to the main input pulley such that the flexible member attachment point moves closer to the vertical plane as the pivotal lever is pivoted upwardly by the flexible member.

28. The exercise machine of claim 27, wherein the flexible member attachment point does not cross over the vertical plane over a full range of motion of the pivotal lever.

29. The exercise machine of claim 26, wherein the pivotal lever is pivoted to the exercise mass assembly at a pivot point, and wherein the flexible member attaches to the pivotal lever at a horizontal elevation that is lower than the elevation of the pivot point.

30. The exercise machine of claim 26, wherein the flexible member attachment point and a pivot axis of the pivotal lever are separated from one another by a distance that defines a lever arm of the pivotal lever, and wherein the lever arm exceeds approximately 50% of the distance between the flexible member attachment point and the main input pulley when the pivotal lever arm is in a lowermost position.

31. The exercise machine of claim 26, wherein the pivotal lever has a length which is configured such that the pivotal lever does not pivot through an angle exceeding approximately 40° during a full range of motion of at lease one exercise.

* * * * *